US012583643B2

(12) United States Patent
Høeg

(10) Patent No.: US 12,583,643 B2
(45) Date of Patent: Mar. 24, 2026

(54) STACKING DEVICE FOR SIDE LOADER

(71) Applicant: GRAM EQUIPMENT A/S, Kolding (DK)

(72) Inventor: Bendt Jensen Høeg, Galten (DK)

(73) Assignee: GRAM EQUIPMENT A/S, Kolding (DK)

( * ) Notice: Subject to any disclaimer, the term of this patent is extended or adjusted under 35 U.S.C. 154(b) by 0 days.

(21) Appl. No.: 18/854,238

(22) PCT Filed: Apr. 4, 2023

(86) PCT No.: PCT/DK2023/050093
§ 371 (c)(1),
(2) Date: Oct. 4, 2024

(87) PCT Pub. No.: WO2023/193868
PCT Pub. Date: Oct. 12, 2023

(65) Prior Publication Data

US 2025/0250047 A1 Aug. 7, 2025

(30) Foreign Application Priority Data

Apr. 4, 2022 (DK) ..... 2022 70180
Jun. 14, 2022 (DK) ..... 2022 70316

(51) Int. Cl.
*B65B 5/10* (2006.01)
*B65B 5/06* (2006.01)
(Continued)

(52) U.S. Cl.
CPC ..... *B65B 35/52* (2013.01); *B65B 5/062* (2013.01); *B65B 5/105* (2013.01); *B65B 25/007* (2013.01); *B65B 35/36* (2013.01); *B65B 35/44* (2013.01)

(58) Field of Classification Search
CPC ..... B65B 5/105; B65B 5/062; B65B 25/007; B65B 35/36; B65B 35/38; B65B 35/52; B25J 9/0093; B25J 9/0084
See application file for complete search history.

(56) References Cited

U.S. PATENT DOCUMENTS 4,555,892 A * 12/1985 Dijkman ..... B65B 5/105 198/374
4,694,637 A * 9/1987 Bech ..... B65B 35/44 53/142
(Continued)

FOREIGN PATENT DOCUMENTS

WO 8203209 A1 9/1982
WO WO-2022009065 A2 * 1/2022 ..... B65B 57/14

OTHER PUBLICATIONS

Danish Search Report for corresponding application PA 2022 70316; Report dated Dec. 12, 2022.
(Continued)

*Primary Examiner* — Andrew M Tecco
(74) *Attorney, Agent, or Firm* — CANTOR COLBURN LLP

(57) ABSTRACT

1. Method of preparing confectionary products for packaging in a side-loader packaging machine, where the confectionary products are conveyed one by one on a first pocket conveyor, and where a picking robot is arranged for picking up a predetermined number of ice cream products from said first pocket conveyor and transferring the confectionary products to a bulking conveyor, said bulking conveyor having compartments suitable to accommodate a predetermined number of confectionary products in one or more layers in each compartment, where the picking robot can be in a first position above one or more compartments to be filled, and a second position above the pocket conveyor, where a) in a first step the picking robot, pick up a prede-
(Continued)

Figure 1:
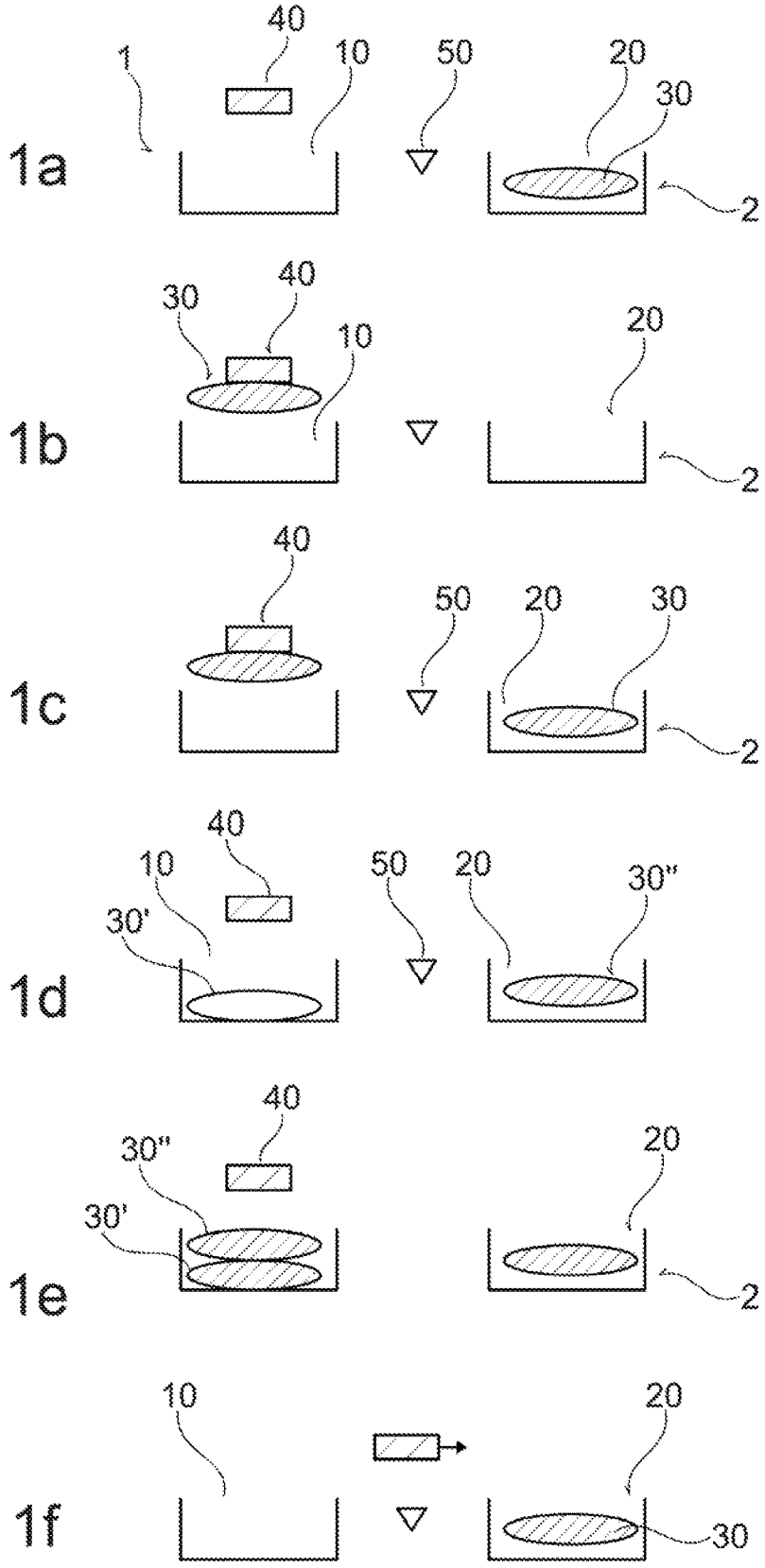

termined number of confectionary products corresponding to the number of confectionary products in a first layer from the pocket conveyor and thereafter positions the picking robot above one or more empty compartments on the bulking conveyor; b) in a further step determine that a further predetermined number of confectionary products corresponding to the total number of confectionary products needed for filling all consecutive layers are available on the pocket conveyor, ready to be picked up; c) releases the picked up confectionary products into the one or more compartment, and d) the picking robot moves to pick up the further predetermined number of confectionary products from the pocket conveyor, and e) transfers the further predetermined number of products to the compartment creating a further layer of confectionary products, and f) repeat steps d) and e)) until the desired number of layers are arranged in the compartment, whereafter g) repeat steps a) to f).

14 Claims, 2 Drawing Sheets

(51) Int. Cl.

| | |
|---|---|
| ***B65B 25/00*** | (2006.01) |
| ***B65B 35/36*** | (2006.01) |
| ***B65B 35/44*** | (2006.01) |
| ***B65B 35/52*** | (2006.01) |

(56) References Cited

U.S. PATENT DOCUMENTS

| | | | | |
|---|---|---|---|---|
| 5,896,728 | A * | 4/1999 | Domino | B65B 21/14 53/385.1 |
| 6,122,895 | A * | 9/2000 | Schubert | B25J 9/026 53/251 |
| 6,209,293 | B1 * | 4/2001 | Powers | B65B 5/105 53/247 |
| 9,038,354 | B2 * | 5/2015 | Davi | B65G 17/12 53/142 |
| 10,775,772 | B2 * | 9/2020 | Lager | B25J 9/0084 |
| 12,338,021 | B2 * | 6/2025 | Carboni | B65B 35/38 |
| 2003/0172617 | A1 * | 9/2003 | Zschoche | B65B 5/08 53/250 |
| 2003/0183481 | A1 * | 10/2003 | Hoeg | B65B 35/54 198/348 |
| 2010/0310348 | A1 * | 12/2010 | Zecchini | B65B 57/12 198/444 |
| 2015/0134110 | A1 * | 5/2015 | Koyanagi | B65G 47/46 700/248 |
| 2017/0096244 | A1 * | 4/2017 | Serra | B65B 35/40 |

OTHER PUBLICATIONS

International Search Report for corresponding application PCT/DK2023/050093 filed Apr. 4, 2023; Report dated Sep. 1, 2023.
Written Opinion for corresponding application PCT/DK2023/050093 filed Apr. 4, 2023; Report dated Sep. 1, 2023.

* cited by examiner

STACKING DEVICE FOR SIDE LOADER

FIELD OF THE INVENTION

The present invention is directed to a method of preparing confectionary products for packing in a side-loader packaging machine.

BACKGROUND OF THE INVENTION

A side-loader packaging machine is used in order to insert a plurality of confectionary products such as for example frozen ice creme products into a carton/box. Upstream from the insertion into the carton/box the desired number of confectionary products are assembled and positioned in what is known as a bulking conveyor. The bulking conveyor comprises compartments and the confectionary products are arranging in the compartment in the desired number and in a layout/manner such that they may easily be inserted into the carton and fits snuggly inside the carton. Typically, the confectionary products will be arranged in one or more layers. The number of products may vary greatly between for example 2 products till 10 or 16 products or more, such that the downstream process of arranging the products to be packed in the side-loader machine must be very versatile. The side-loader machine, which is not part of the present invention, may be dedicated to certain carton size or may be adaptable to various carton sizes such that the compartments on the bulking conveyor likewise may be adapted to accommodate various number of products.

Particularly in the ice-cream industry, the production rate is very high such that typically between 200 and 300 products shall be handled and packed each minute, which requires a very rapid arrangement of the desired number of products in the compartments in the bulking conveyor. For this purpose, it is well known to arrange each product in one or more parallel pocket conveyors, which pocket conveyor(s) then assures that one product is placed in each pocket. As the pockets are filled and progress, a number of robots will pick up the products from the pockets and place them in the compartments. Examples of such installations are disclosed in for example US 2010/0310348A1 and US 2003/0183481 A1. Typically, more robots will cooperate in order to arrange the products in the compartments which in turn requires a very reliable counting and control mechanism such that the control mechanism keeps track of how many products are placed in each layer in the compartment and instructs the robots to pick up the necessary products from the pocket conveyors and place them in the compartments. These prior art arrangements are typically very complex, involves a number of robots and thereby requires advanced software and at the same time are relatively expensive due to the number of robots involved, and necessary floor area to accommodate the arrangement.

OBJECT OF THE INVENTION

Consequently, it is the object of the present invention to provide a simpler, faster and more reliable manner of arranging the products in the compartment on the bulking conveyor without compromising the quality.

DESCRIPTION OF THE INVENTION

The present invention addresses this by providing a method of preparing confectionary products for packaging in a side-loader packaging machine, where the confectionary products are conveyed one by one on a first pocket conveyor, and where a picking robot is arranged for picking up a predetermined number of ice cream products from said first pocket conveyor and transferring the confectionary products to a bulking conveyor, said bulking conveyor having compartments suitable to accommodate a predetermined number of confectionary products in one or more layers in each compartment, where the picking robot can be in a first position above one or more compartments to be filled, and a second position above the pocket conveyor, where a) in a first step the picking robot, pick up a predetermined number of confectionary products corresponding to the number of confectionary products in a first layer from the pocket conveyor and thereafter positions the picking robot above one or more empty compartments on the bulking conveyor;

b) in a further step determine that a further predetermined number of confectionary products corresponding to the total number of confectionary products needed for filling all consecutive layers are available on the pocket conveyor, ready to be picked up;

c) releases the picked up confectionary products into the one or more compartment, and d) the picking robot moves to pick up the further predetermined number of confectionary products from the pocket conveyor, and e) transfers the further predetermined number of products to the compartment creating a further layer of confectionary products, and f) repeat steps d) and e)) until the desired number of layers are arranged in the compartment, whereafter g) repeat steps a) to f).

As is evident from the method, the picking robot collects a product corresponding to the first layer and then positions itself above an empty compartment on the bulking conveyor. The robot remains in this position until it is detected that sufficient products are available on the pocket conveyor for filling the next or the next subsequent layers at which time the robot releases the products into the compartment and quickly collects the further products constituting the next layer or the next plurality of layers. In this manner it is assured that a compartment is filled rapidly and without hesitation. For example with the prior art devices it may be that the products are not available in the pocket conveyor or that not enough products are available in the pocket conveyor such that the bulking conveyor with the compartments must wait for a compartment to be filled up with the desired number products even though further compartments upstream may already be ready to be transferred to the side-loader machine. This is a great advantage in that it is assured that all compartments are filled once the filling procedure starts and at the same time only one robot is necessary in order to carry out the process.

In instances where it is desirable to have the products layered in more than two layers, the sensor will register that enough products are available in the pocket conveyor for filling up the subsequently layers, for example layers 2, 3 and 4, before the first layer of products is released into an empty compartment.

Due to the ability to fill up entire compartments, it is possible to allow the bulking conveyor and the pocket conveyor to move at constant or variable speed such that a continuous process is provided.

In a still further embodiment advantageous embodiment, the picking robot comprises a plurality of separate picking arms, each arm provided with a vacuum collection member, and a valve mechanism for activating a desired number of vacuum collecting members corresponding to the desired predetermined number of confectionary products in each layer.

As the number of products needed in each compartment depends on the desired number of products in the finished carton, which may vary greatly, only the correct number of robot arms or product engagement means, such as for example vacuum collecting members are activated during the process.

However, in a further advantageous embodiment the predetermined number of the predetermined number of confectionary products may correspond to the desired number of confectionary products in a single layer in two or more adjacent compartments, such that when the predetermined number of confectionary products are released in step c) and e) a layer of confectionary products will be positioned in two or more adjacent compartments.

As the robot comprises a plurality of separate collection arms, it is possible for the robot to collect products from the pocket conveyor corresponding to the number of products needed to fill a first layer in two or more adjacent compartments. The robot will pick up the desired number of products and reposition itself above a plurality of compartments corresponding to the number of products in the first layer (for all compartments) and only release the products into the two or more compartments once the system indicates that available products are available in the pockets on the pocket conveyor for filling up the next or the next plurality of layers as already described above. In this manner a very speedy and efficient process is obtained using only a single picking robot.

Of course, it is contemplated within the scope of the invention that a plurality of pocket conveyors may be arranged in parallel.

DESCRIPTION OF THE DRAWINGS in the drawing

FIG. 1*a* to 1*f* illustrate the method steps of the present invention

Figure 2:
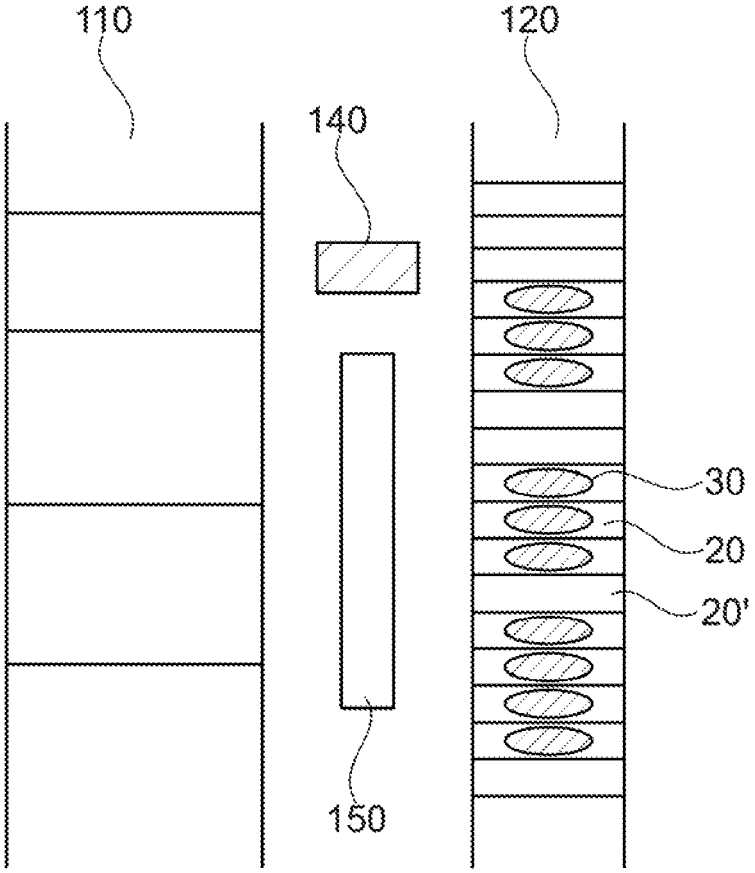

FIG. 2 illustrates a schematic overview of a possible lay out facilitating the invention

DETAILED DESCRIPTION OF THE INVENTION

In FIG. 1*a* through 1*f* the inventive method of preparing confectionary products for packaging in a side-loader machine will be described.

A side-loader machine is used in many production lines where singular objects are packaged for example in cartons. In order to achieve the optimum packing, the objects to be packaged are pre-stacked, such that a complete stack of products may be slid into the carton sideways (i.e. without being handled further). A stack may comprise a number of layers, where each layer comprises a predetermined number of objects. For example, each layer may comprise four objects, and by creating three layers, twelve products are prepared for being introduced into the package in the side-loader machine.

The schematic steps illustrated in FIG. 1*a* through FIG. 1*f* is a simplified sketch of the actual procedure. Many details relating to the robot(s), conveyors, machine etc. are left out on purpose in order to illustrate the concept.

In FIG. 1*a* is illustrated a compartment 10 arranged in a bulking conveyor 1. A pocket 20 arranged in a pocket conveyor 2 is arranged next to the bulking conveyor 1. There may be arranged a plurality of parallel pocket conveyors 2. In order to illustrate the principles of the present invention only a single pocket conveyor 2 is illustrated.

In the pocket 20 is arranged a product 30. This product 30 may in principle be any type of product but typically this method is used with frozen ice cream products or other confectionary products.

A picking robot, illustrated by the robots' engagement pad 40 is illustrated above the compartment 10.

Further a sensor 50 is arranged such that the sensor may detect the presence or non-presence of a product 30 in the pocket 20. Typically, the sensor 50 will be arranged such that it detects the presence or absence of a plurality of products 30.

In a first method step the sensor detects that a predetermined number of confectionary products 30 corresponding to the number of confectionary products in a first layer is present on the pocket conveyor 2. The robot picks 40 up the predetermined number of products 30 and thereafter positions the products 30 above one or more empty compartments 10 on the bulking conveyor 1.

Depending on the number of products in each layer, the robot may pick up a number of products corresponding to filling a first layer in more than one compartment.

This is illustrated in FIG. 1*b*, where the robot 40 with products 30 is waiting above an empty compartment 10. The pocket 20 is empty.

In FIG. 1*c* the sensor 50 detects that products 30 corresponding to the predetermined number of confectionary products 30 for a layer is present on the pocket conveyor 2. The robot 40 then releases the first collected products 30, such that the products 30, as illustrated in FIG. 1*d* are placed as a first layer of products 30' in the compartment 10. The robot 40 then moves on to collect the next layer of products 30 from the pocket conveyor. These products 30" are then placed on top of the former layer of products 30' in the compartment 10, as illustrated in FIG. 1*e*. The pockets 20 on the pocket conveyor are empty.

In the next step, as illustrated in FIG. 1*f* the sensor detects the presence of products 30 on the pocket conveyor corresponding to the number of products in a layer, and prepares the robot 40 to collect the products and place the robot as described above with reference to FIG. 1*a*, above an empty compartment, see FIG. 1*b*. At this time a complete cycle is completed filling two layers into a compartment. The compartment 10 may at this time proceed to the side-loader machine.

For some products or applications, it is desirable to stack more than two layers. In these instances, the sensor 50 in the method step, corresponding to FIG. 1*c* must make sure that products are available on the pocket conveyor, corresponding to the total number of products necessary for completing the additional layers. For example, if four layers comprising four products in each layer is to be packaged, the robot will pick up the first four products and wait above an empty compartment until the sensor registers that twelve products are available on the pocket conveyor. When the twelve products are registered the robot will release the first four products into the empty compartment. The robot will then pick up the next layer, deposit it on top of the first layer, pick up the third layer and deposit it on top of the second layer and finally pick up the fourth layer and deposit it on top of the third layer. At this time four layers of four products are deposited in the compartment. The compartment can then proceed to the side-loader machine for packaging. Once the compartment is filled up with desired layers, the robot will return to the position as described above with reference to FIG. 1*a*.

In FIG. 2 is schematically illustrated part of a production line 100 comprising a bulking conveyor 110, a pocket conveyor 120, and a picking robot 140 and a sensor 150.

The products 30 are loaded onto the pocket conveyor upstream (not illustrated) in such a manner that one product 30 is placed in each pocket 20. Some pockets 20' may be empty due to failure to fill them correctly upstream. In practice only very few pockets are empty.

If an array of filled pockets 20 does not correspond to the number of products to fill a layer in the compartment 10, the robot let the products pass. These products 30 are recycled and refilled into pockets upstream. In embodiments where additional layers on top of the first layer are to be placed on top of the first layer, the robot 140 will only be activated when the sensor 150 detect that sufficient products are available on the pocket conveyor, corresponding to the total number of products needed to fill all layers in the compartment.

The invention claimed is:

1. Method of preparing confectionary products for packaging, where the confectionary products are conveyed one by one on a first pocket conveyor, and where a picking robot comprising one or more picking arms is arranged for picking up a predetermined number of confectionary products from said first pocket conveyor and transferring the confectionary products to a bulking conveyor, said bulking conveyor having compartments suitable to accommodate a predetermined number of confectionary products in one or more layers in each compartment, where the method comprises the following steps;

a) the one or more arms of the picking robot, picks up a first predetermined number of confectionary products corresponding to the number of confectionary products in a first layer from the pocket conveyor and thereafter holds the first predetermined number of confectionary products in a suspended position relative to one or more empty compartments on the bulking conveyor, b) while the first predetermined number of confectionary products are held in the suspended position, determining that a second predetermined number of confectionary products corresponding to the total number of confectionary products needed for filling one or more consecutive layers are available on the pocket conveyor are ready to be picked up;

c) after determining the availability of the second predetermined number of confectionary products, releasing the picked up confectionary products from the suspended position into the one or more compartments in a first layer, and d) moving the one or more arms of the picking robot to pick up the second predetermined number of confectionary products from the pocket conveyor and picking up the second predetermined number of confectionary products, and e) transferring the second predetermined number of confectionary products to the one or more compartment creating a further layer of confectionary products.

2. Method according to claim 1 wherein the confectionary products are frozen ice cream products.

3. Method according to claim 1, where the bulking conveyor and/or the pocket conveyor moves at constant or variable speed.

4. Method according to claim 1, where the predetermined number of confectionary products is between 3 and 24 confectionary products.

5. Method according to claim 1, where the picking robot comprises a plurality of separate picking arms, each arm provided with a vacuum collection member, and a valve mechanism for activating a desired number of vacuum collecting members corresponding to the desired predetermined number of confectionary products in each layer.

6. Method according to claim 1, where the predetermined number of confectionary products may correspond to the desired number of confectionary products in a single layer in two or more adjacent compartments, such that when the predetermined number of confectionary products are released in step c) and e) a layer of confectionary products will be positioned in two or more adjacent compartments.

7. Method according to claim 1, wherein said bulking conveyor and/or pocket conveyor stops moving during the process.

8. Method according to claim 1, wherein the method comprises the following steps:

f) repeating steps d) and e) until the desired number of layers are arranged in the one or more compartments.

9. Method according to claim 8, wherein the method comprises the following steps: repeat steps a) to f).

10. Method according to claim 1, wherein the one or more compartments comprises a carton or a box.

11. Method according to claim 1, wherein said first layer is a first layer placed in two or more compartments at the same time/simultaneously.

12. Method according to claim 1, wherein further layers are placed in the two or more compartments at the same time/simultaneously.

13. Method according to claim 1, wherein the confectionary products are picked from a plurality of pocket conveyors.

14. Method according to claim 1, wherein unpicked confectionary products may be recycled.

* * * * *